US008297490B2

(12) United States Patent
Little et al.

(10) Patent No.: US 8,297,490 B2
(45) Date of Patent: Oct. 30, 2012

(54) MATERIALS FOR AND METHOD FOR MANUFACTURING A CONTAINER WITH CORNER SUPPORTS AND THE RESULTING CONTAINER

(75) Inventors: Troy Little, Thomasville, PA (US); Jamie L. Laughman, East Berlin, PA (US)

(73) Assignee: York Container Company, York, PA (US)

( * ) Notice: Subject to any disclaimer, the term of this patent is extended or adjusted under 35 U.S.C. 154(b) by 462 days.

(21) Appl. No.: 12/752,355

(22) Filed: Apr. 1, 2010

(65) Prior Publication Data

US 2010/0234201 A1 Sep. 16, 2010

Related U.S. Application Data

(63) Continuation-in-part of application No. 12/121,414, filed on May 15, 2008, now Pat. No. 7,819,305, and a continuation-in-part of application No. 12/323,821, filed on Nov. 8, 2008, now Pat. No. 8,177,117.

(60) Provisional application No. 61/165,716, filed on Apr. 1, 2009.

(51) Int. Cl.
*B65D 5/50* (2006.01)
*B65D 5/56* (2006.01)

(52) U.S. Cl. ..... 229/122.32; 229/191; 229/199

(58) Field of Classification Search ..... 229/117, 229/117.01, 120.31, 122.32, 165, 185.1, 229/191, 199; 206/170–191
See application file for complete search history.

(56) References Cited

U.S. PATENT DOCUMENTS

| | | | | |
|---|---|---|---|---|
| 499,654 | A | 6/1893 | Clark | |
| 959,261 | A | 5/1910 | Reber | |
| 2,002,618 | A | 5/1935 | Sutter | |
| 2,134,964 | A | 11/1938 | Whitehead | |
| 2,148,533 | A | 2/1939 | Chapman | |
| 2,766,923 | A | 10/1956 | D'Esposito | |
| 2,771,986 | A | 11/1956 | Bekoff | |
| 2,884,179 | A | 4/1959 | Rossum | |
| 2,894,672 | A | 7/1959 | Bamburg | |
| 2,903,176 | A | 9/1959 | Crane | |
| 2,922,552 | A | 1/1960 | Berger et al. | |
| 2,939,620 | A | 6/1960 | Royce | |
| 3,017,064 | A | 1/1962 | Davis | |
| 3,034,698 | A | 5/1962 | Forrer | |
| 3,048,318 | A | 8/1962 | Sabin | |
| 3,155,234 | A | 11/1964 | Knoll et al. | |
| 3,236,433 | A | 2/1966 | Barrett | |
| 3,288,348 | A * | 11/1966 | Brackett | 229/199 |
| 3,373,921 | A | 3/1968 | Crane | |
| 3,397,831 | A | 8/1968 | Adams | |
| 3,696,990 | A | 10/1972 | Dewhurst | |
| 3,765,044 | A | 10/1973 | Hanahan et al. | |

(Continued)

FOREIGN PATENT DOCUMENTS

FR 2641758 7/1990

*Primary Examiner* — Gary Elkins
(74) *Attorney, Agent, or Firm* — Barnes & Thornburg LLP

(57) ABSTRACT

A method of manufacturing containers, the resulting containers therefrom and the associated pre-assemblies and blanks used in the method and in the resulting containers. The method includes cutting a primary blank and at least one supplementary blank, affixing them together to form a pre-assembly, and assembly the container from the pre-assembly.

49 Claims, 12 Drawing Sheets

U.S. PATENT DOCUMENTS 3,912,159 A 10/1975 Danville
3,982,684 A 9/1976 David
4,056,223 A 11/1977 Williams
4,058,249 A 11/1977 Buck
4,068,796 A 1/1978 Kullman, Jr.
4,197,980 A 4/1980 Johnson
4,403,729 A 9/1983 Wytko
4,605,158 A 8/1986 Barton
4,759,495 A * 7/1988 Moon ..... 229/122.32
4,834,255 A * 5/1989 Boots ..... 229/199
4,874,125 A 10/1989 Bates
4,927,073 A 5/1990 Esposito
4,948,033 A * 8/1990 Halsell et al. ..... 229/122.33
4,961,500 A 10/1990 Coulombe
5,213,220 A 5/1993 McBride
5,294,044 A 3/1994 Clark
5,315,936 A 5/1994 Smith
5,350,109 A 9/1994 Brown et al.
5,375,715 A 12/1994 Serre et al.
5,400,955 A 3/1995 Coalier et al.
5,415,345 A 5/1995 MacKinnon
5,505,368 A 4/1996 Kanter et al.
5,520,325 A 5/1996 Quaintance
5,673,848 A 10/1997 Garza
5,791,555 A 8/1998 Kanter
5,853,120 A 12/1998 McLeod
5,947,292 A 9/1999 Chelfi
5,957,294 A 9/1999 Kanter
5,975,413 A 11/1999 Moen
5,979,746 A 11/1999 McLeod et al.
5,988,491 A * 11/1999 Morrison ..... 229/122.32
6,015,084 A 1/2000 Mathieu et al.
6,068,140 A 5/2000 Mangrum et al.
6,085,969 A 7/2000 Burgoyne
6,138,904 A 10/2000 Baird et al.
6,158,653 A 12/2000 Kanter et al.
6,189,778 B1 2/2001 Kanter
6,189,780 B1 2/2001 Kanter
6,270,007 B1 8/2001 Jensen, Jr.
6,325,282 B1 12/2001 Kanter et al.
6,513,705 B1 2/2003 Sheffer
6,712,214 B1 3/2004 Wintermute et al.
6,719,191 B1 4/2004 Christensen et al.
6,817,514 B2 11/2004 Kanter et al.
6,868,968 B1 3/2005 Casanovas
6,874,679 B2 4/2005 Tibbles et al.
6,948,617 B2 9/2005 Kanter et al.
6,962,558 B2 11/2005 Dalrymple
7,066,379 B2 6/2006 McLeod et al.
7,290,696 B2 11/2007 McClure
7,624,912 B2 * 12/2009 Churvis ..... 229/191
7,810,707 B2 * 10/2010 Little ..... 229/122.32
7,819,305 B2 * 10/2010 Little ..... 229/122.32
8,177,117 B2 * 5/2012 Little ..... 229/120.18
2003/0146130 A1 8/2003 Kanter et al.
2005/0161496 A1 7/2005 McLeod et al.
2005/0189258 A1 9/2005 Vastola
2005/0230273 A1 * 10/2005 Kohler ..... 206/170
2005/0242164 A1 11/2005 Teixidor Casanovas
2006/0060643 A1 3/2006 Sheffer
2006/0124712 A1 6/2006 Weimer, Jr.
2006/0196920 A1 9/2006 Moen
2007/0108261 A1 5/2007 Schuster
2007/0187346 A1 8/2007 Markson et al.
2008/0169339 A1 7/2008 Moser
2008/0169340 A1 7/2008 Sheffer
2008/0265726 A1 10/2008 Sheffer
2010/0083618 A1 4/2010 Little

* cited by examiner

MATERIALS FOR AND METHOD FOR MANUFACTURING A CONTAINER WITH CORNER SUPPORTS AND THE RESULTING CONTAINER

This application claims benefit to and priority of U.S. Provisional Application No. 61/165,716 filed on Apr. 1, 2009 and is a continuation-in-part of prior U.S. patent application Ser. Nos. 12/121,414, filed on May 15, 2008 now U.S. Pat. No. 7,819,305, and Ser. No. 12/323,821 filed on Nov. 8, 2008 now U.S. Pat. No. 8,177,117, the entirety of all three application being incorporated herein by reference.

BACKGROUND AND SUMMARY

The present disclosure relates in general to a method of manufacturing and the material used to manufacture packaging/containers. Such packaging/containers may be readily used to transport product and/or display the contents of the packaging/containers following delivery of the packaging/containers to a user.

Various packages and containers are conventionally provided for transporting product to and storing product in a retail environment and for display to prospective customers. As is conventionally known in the packaging industry, such containers can be transported to manufacturing and/or retail environments for display in knock-down form, i.e., flattened but otherwise being glued, stapled or otherwise affixed or joined together, such that they are already substantially pre-assembled. In such a knock-down state, personnel assembling the container need only open the sides and/or ends of the container and affix the container bottom wall or walls into its assembled condition or the container can be moved to its assembled condition by an automated process requiring no personnel to actually move any of the sides and/or ends of the container. As a result, such final assembly may be performed prior to loading manufactured product. Alternatively, such final assembly may be performed such that the product can be placed into a resulting assembled container for ready display.

Conventionally, it has been deemed advantageous at times to stack a plurality of such containers, one on top of the other, for the purposes of transport to a retail environment or during display in the retail environment. In this use, it is necessary that the containers stacked above the bottom-most container are amply supported and also that a stack of a number of such containers, when loaded with product, will not collapse.

The following is a simplified summary to provide a basic understanding of aspects of various embodiments according to the present disclosure.

In accordance with the present disclosure and the illustrated embodiment or embodiments, a method of manufacturing containers, the resulting containers, and the associated blanks and pre-assemblies used are provided, which, when utilized, result in a container that has increased side panel strength and corner strength so as to enable a manual and/or an automated erection or final assembly of the resulting container via a manual or an automated process and the effective vertical stacking of containers when the container includes product.

Additionally, in accordance with the present disclosure, the manufactured container provides the dual use of being both a transporting container for transporting product to a retail environment and a display container configured to display the product in that retail environment.

Other aspects of the present disclosure will become apparent from the following descriptions when considered in conjunction with the accompanying drawings.

DETAILED DESCRIPTION

Figure 1:
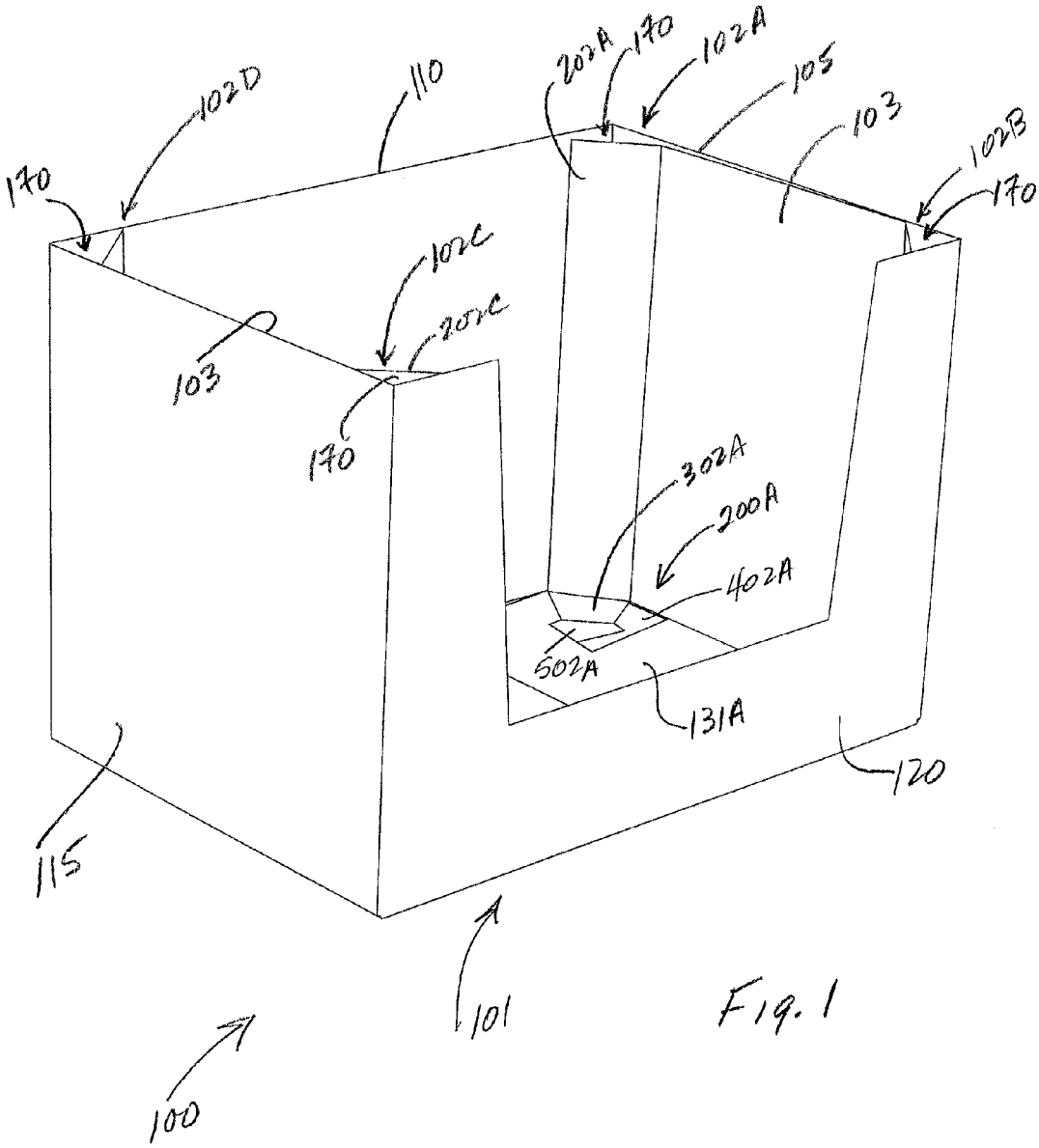
FIG. 1 is a perspective view of an assembled and fully erected container manufactured in accordance with the present disclosure.

In the following description of an embodiment or embodiments in accordance with the present disclosure, reference is made to the accompanying drawings. It is to be understood that other embodiments may be utilized and structural and functional modifications may be made without departing from the scope and spirit of the present disclosure.

The manufacture and use of containers that may be used for more than one purpose, e.g., for transport of product and subsequent display of product in a retail environment, are becoming increasingly popular among both manufacturers and retailers because such containers enable a reduction or minimization of the amount of container material while increasing or maximizing the amount of display space available for product. Thus, it is conventionally known that blanks, e.g., items made from some type of paperboard and/or other material that is die-cut and scored for subsequent manipulation to form a pre-assembly or pre-assemblies, e.g., a partially assembled container wherein the blank, or blanks, is manipulated and affixed to itself, or to each other but is not finally assembled. Containers, e.g., packaging, cartons, boxes, etc., made from the pre-assembly or pre-assemblies, may be provided that enable product to be transported to a retail environment in a transporting container and displayed in the retail environment within the transporting container. Minor modification of the container may be required.

The durability, strength and stackability of such packaging or containers often require increasing the amount of material content within the container. However, further reducing the amount of material content within containers has become a significant goal of many manufacturers and retailers because of the adverse effect that container has on landfills and the environment in general as well as the cost of manufacturing, transporting and disposing of such containers. In addition, it is desirable, where appropriate, to manufacture containers by using two pieces of material, or blanks, with one blank used to produce the container and the other to create a tray and/or to reinforce the corners. Such use of two blanks may be more cost effective and/or efficient rather than attempting to achieve the cost effectiveness or efficiency with only one blank.

Thus, both manufacturers and retailers are recognizing a need to reduce the number of containers used to provide product to an end-consumer in a retail supply chain. Thus, is done in an effort to conserve natural resources, reduce an impact on the environment, improve efficiency by saving the time it takes to erect a container by reducing the number of human touches it takes, and reduce costs associated with product manufacture and sale. In an effort to achieve these goals, various initiatives have been put in place by both suppliers and retailers to reduce the overall number of product containers and the materials used therein by some percentage, e.g., five percent.

One conventional mechanism for reducing the amount of containers necessary to provide product to potential consumers in a retail environment is by providing dual-use containers wherein a container can be used both to contain product during transporting and also to display the product once that product has arrived in a retail environment, e.g., a store or other environment offering product for sale.

Further, in an effort to further use available space in a retail environment, retailers may be interested in using the display function of such dual-use containers in a manner such that containers may be stacked on top of one another to improve or optimize vertical space utility in the retail environment. Simply put, having the ability to be able to stack display cartons enables a store operator to present more product and/or different types of product in a manner that a customer can see. For example, by providing the opportunity to stack such containers, e.g., display cartons, on a counter, a store operator is able to increase the use of counter space such that more than one carton can occupy the same horizontal counter foot print. As is understood in the retail industry, such a configuration increases sales because customers are able to see more available product and product types for sale.

However, a problem with stacking such display cartons and shipping cartons, whether such packaging is dual-use transporting/display containers or otherwise, is that the weight of the carton(s) in combination with the weight of the product(s) stored in the container(s) can cause one or more containers to be damaged or collapse. As a result, a store operator is left with damaged, ineffective or completely non-functioning display container(s), which causes operational problems and reduces likelihood of sales to consumers.

Accordingly, based on all of these factors, there is a need to provide a method of manufacturing reduced-material content-containers and associated pre-assemblies and blanks, which, when utilized, result in a container that has significantly improved stacking strength, or anti-nesting characteristics, over conventional containers and optionally provides the dual use both as a transporting container for transporting product to a retail environment and a display container configured to display the product in that retail environment. With this understanding of one area of packaging/container utility in mind, a description of at least one illustrative embodiment, according to the present disclosure, follows.

According to at least one illustrated embodiment, there is disclosed a shipping container, display container and/or a dual-use container, e.g., for transporting product and subsequent display of the product, as well as corresponding container pre-assemblies and blanks, that includes, overall, a reduced amount of material content while maintaining or increasing the stacking strength of such a container by the use of internal support sections in the corners of the container. Such internal support sections may allow for a reduction of the material in the outer shell of the container leading to an overall reduction in the amount of material. In view of recent retailer initiatives to reduce the amount of material content in containers, such containers may have increased utility to manufacturers and retailers. Thus, providing containers with reduced material content and requiring fewer human touches to erect a container using a manual or an automated process would be of increased value. Additionally, because of the unique structure provided in accordance with the at least one illustrated embodiment, side wall strength may be increased as well.

Additionally, based on the at least one illustrated example of a container provided with corner support sections, as disclosed herein, it should be appreciated that the incorporation of the support sections also increases stackability of the resulting containers without requiring a lengthier time period for final assembly and without a need for assemblers (either human or automated or semi-automated equipment) to have superior capabilities. This is because, as explained herein, the majority, if not all, of manipulation of the pre-assembly to form or put in place the corner support sections is already performed as part of the final assembly of the container. As a result, the additional operations needed to provide for the corner support sections, in accordance with the present disclosure, is reduced or eliminated relative to what would be conventionally required for installing or assembling conventional corner supports.

Understanding of the manufacturing of a container, blanks and/or pre-assemblies, in accordance with the present disclosure, may best be understood by first introducing a manufactured container in accordance with an illustrated embodiment and according to the present disclosure.

Figure 2:
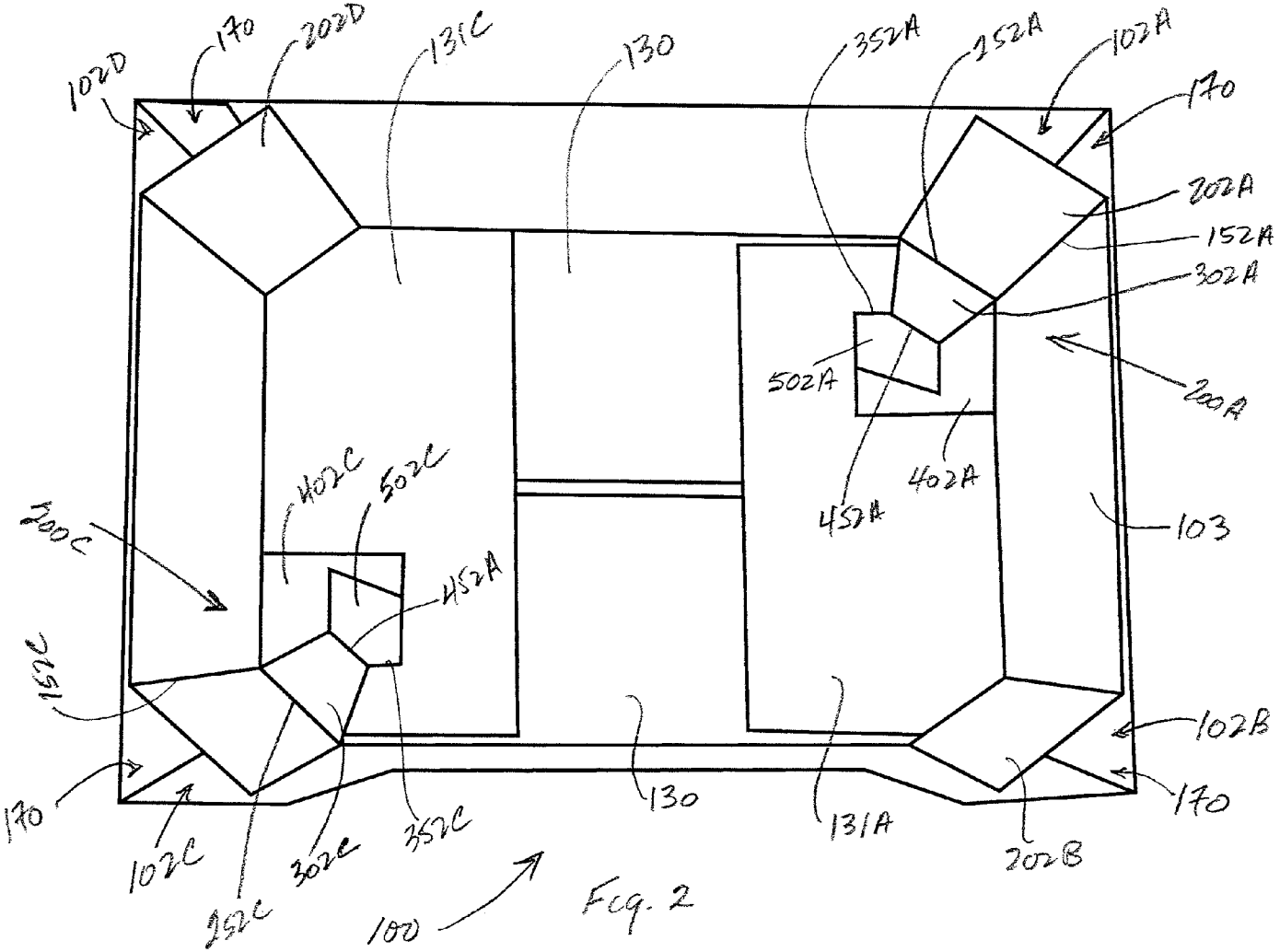
FIG. 2 is a top view of the container of FIG. 1.

FIG. 1 illustrates a side perspective view and FIG. 2 illustrates a top view of a container 100 manufactured in accordance with the present disclosure. As shown in FIGS. 1 and 2, container 100 may include one or more support sections 102A-D disposed at the corners of the container 100, which, in this example, is a dual-use container of the type referred to in the packaging industry as a half regular carton with one or more cut-outs for display purposes. However, it should be understood that the manufactured container 100 may be any type of carton, package, box, etc. of any suitable type.

Figure 3:
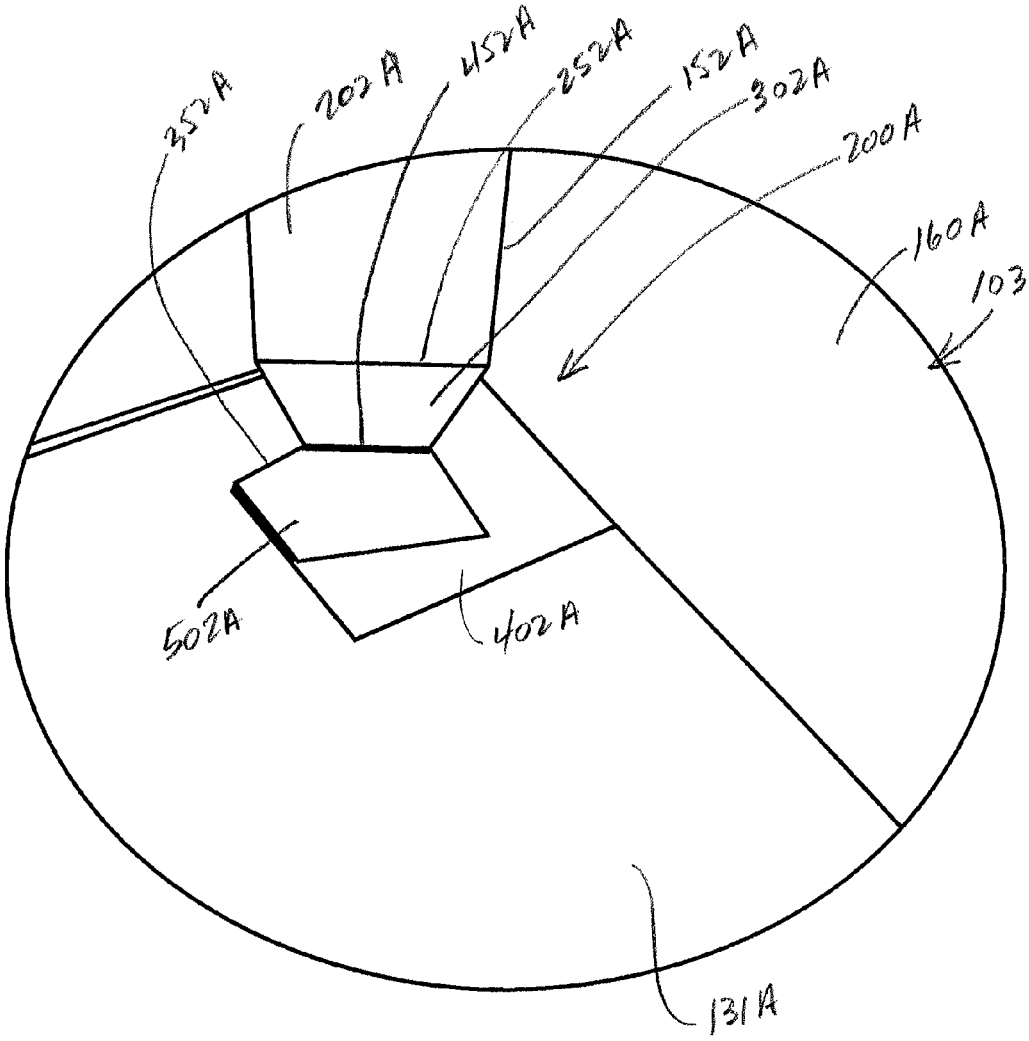
FIG. 3 is an enlarged view of an interior portion of one of the corners of the container of FIG. 1.
Figure 6:
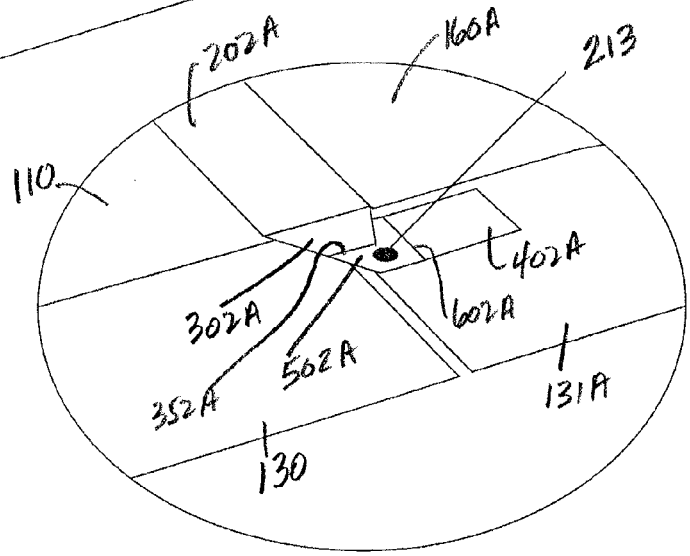
FIG. 6 is an enlarged view of a portion of an area of attachment of the primary and supplementary blanks of FIG. 5.
Figure 8:
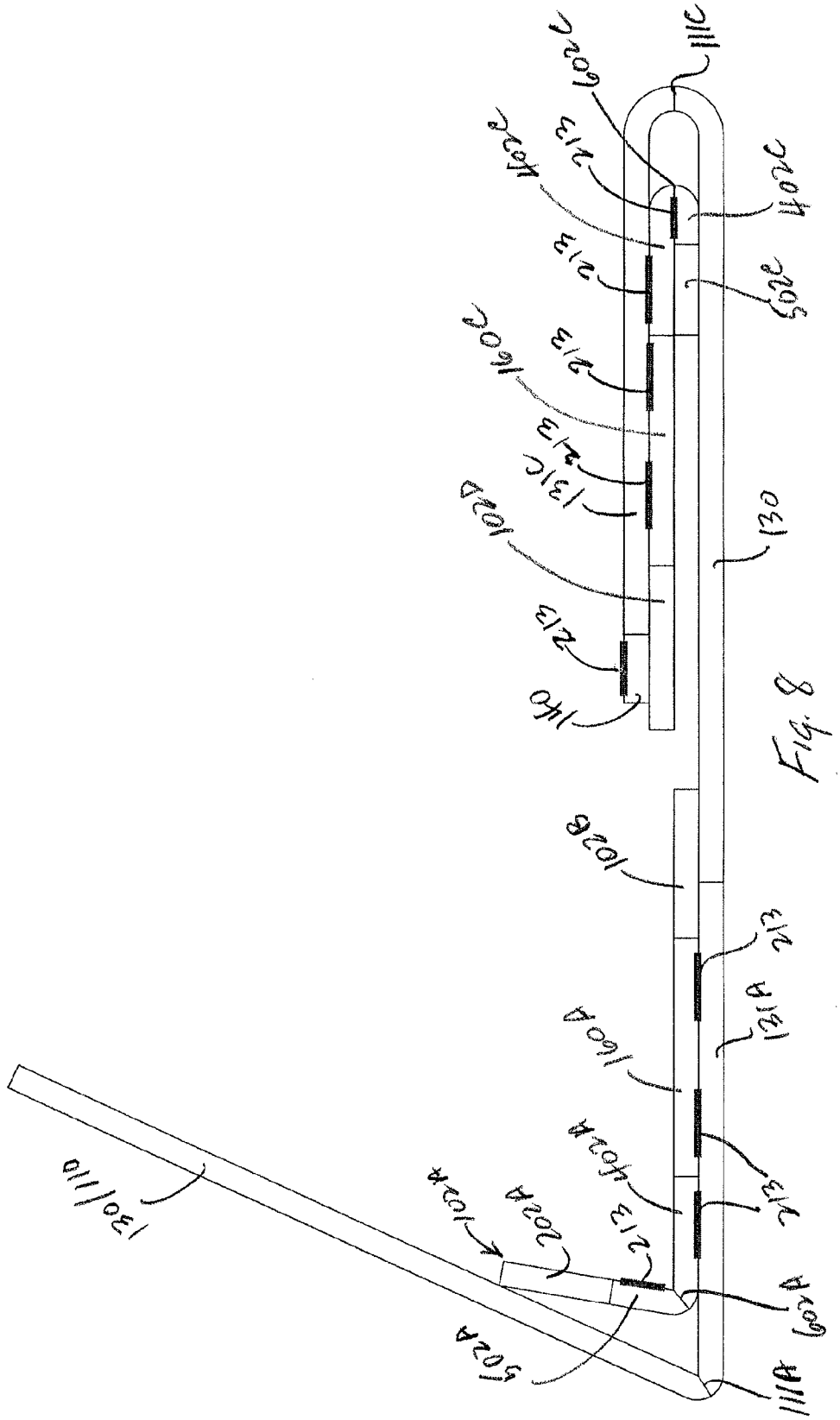
FIG. 8 is a cut-away view of a partially flattened pre-assembly viewed from a bottom of the pre-assembly and showing the layering of materials of the pre-assembly, in accordance with the present disclosure.

As shown in FIG. 1, a primary blank 101 forms the exterior of container 100 while the support sections 102A-D are part of supplementary blanks 103 which supplementary blanks 103 are attached to interior portions of primary blank 101, as shown in more detail in FIGS. 6 and 8. Primary blank 101 may include bottom panels designated as major flaps 130 and minor flaps 131A and 131C. Support sections 102A-D may further improve the strength and stackability of container 100. Support sections 102A,C are disposed in opposing corners of container 100 as are support sections 102B,D. As will be further discussed later herein, support sections 102A and 102C are, for exemplary purposes, designated as outboard support sections and support sections 102B and 102D are designated as inboard support sections. Support section 102A is comprised of a panel 202A, an extension 302A coupled to panel 202A via working score 252A, a tab 502A coupled to extension 302A via working score 452A, and a tab 502A having been folded at knife cut 352A and affixed to pad 402A. Extension 302A, pad 402A, tab 502A and minor flap 131A form means or a panel mover 200A for moving support panel 202A into a position extending diagonally across its respective corner of container 100 when container 100 is erected, as shown in FIGS. 1 and 2. An enlarged view of panel mover 200A is shown in FIG. 3. Support section 102C is structured the same and operates the same as support section 102A and comprises a panel 202C, an extension 302C, a pad 402C, and a tab 502C, which elements combine with minor flap 131C to form means or panel mover 200C, acting similarly to panel mover 200A. Support sections 102B and 102D include panels 202B and 202D, respectively.

Figure 7:
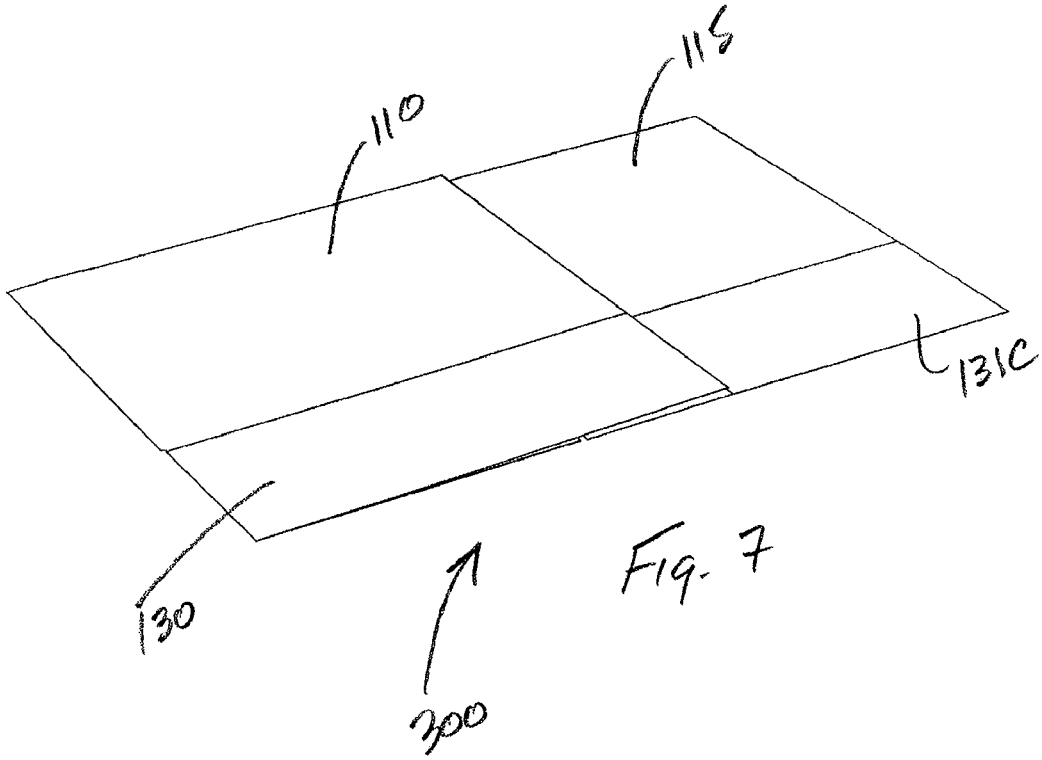
FIG. 7 is a perspective view of the primary and secondary blanks of FIG. 5 in a final stage of assembly of the pre-assembly for the container of FIG. 1.

One of the reasons for support sections 102A and 102C being comprised differently from support sections 102B and 102D is for ease of erecting the container 100 by reducing the number of human touches or allowing for automated steps to erect container 100 (see FIGS. 1 and 2) from a pre-assembly 300 (see FIG. 7 and also FIG. 8 for the pre-assembly 300 not in its final, flat position). The panels 202C and 202D of support 102B and 102D are configured to "snap into place" in a position extending diagonally across their respective corners when the pre-assembly 300 of FIG. 7 is opened into a partially erected position (see FIG. 9). However, support panels 202A and 202C of support sections 102A and 102C are not so configured because of the orientation they must assume in the flattened, pre-assembly configuration, as shown in see FIG. 6. Thus, panel movers 200A and 200C are used to automatically move panels 202A and 202C into their respective positions extending diagonally across their respective corners when the container is erected to its final assembled condition.

Figure 4:
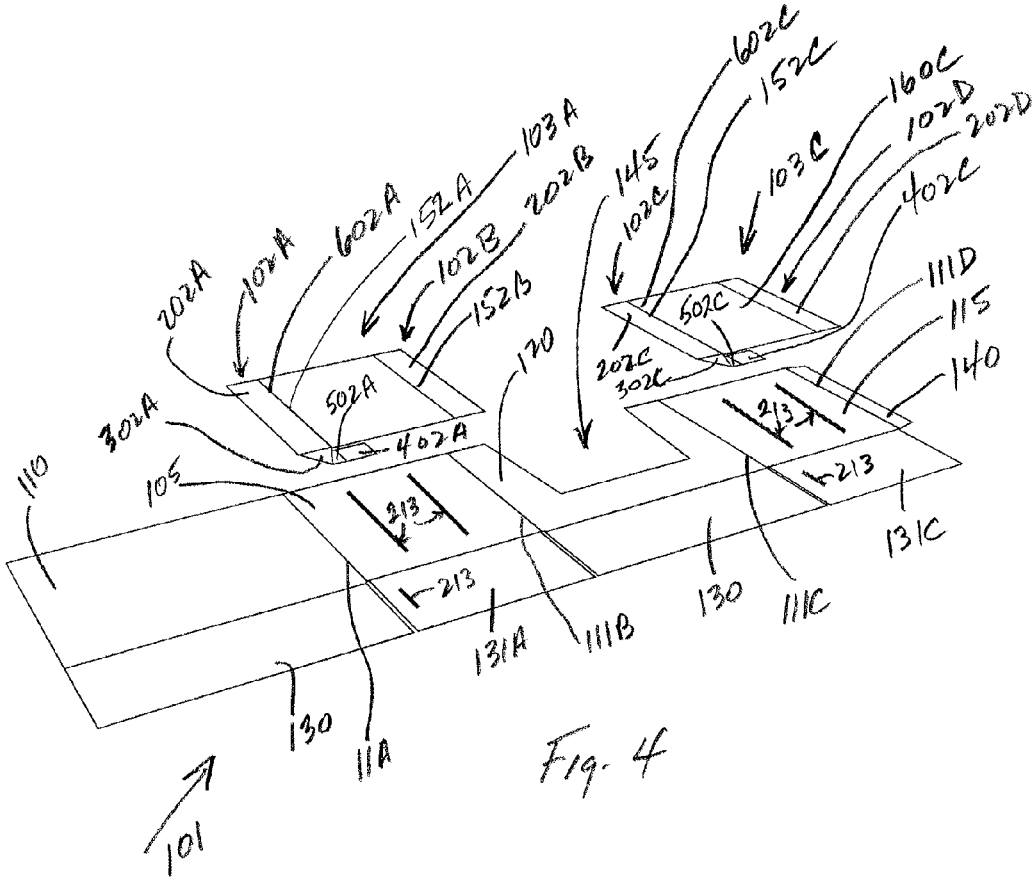
FIG. 4 is a perspective view of a primary blank and two supplementary blanks used in manufacturing the container of FIG. 1.

FIG. 4 illustrates an example of a primary blank 101 and two supplementary blanks 103A and 103C. As shown in FIG. 4, the primary blank 101 includes four panels: first and second side panels 105, 115; a back panel 110; and, a front panel 120, these panels being separated by fold lines 111A-C. The blank 101 also includes four bottom panels 130, 131A, 131C, which cooperate and interact to form a bottom when the container 100 is finally assembled or erected. An adhesive panel 140, separated from side panel 115 by fold line 111D, is used as part of pre-assembly manufacturing to affix an edge of the side panel 115 with an edge of back panel 120. Accordingly, as part of pre-assembly manufacturing discussed further later, adhesive panel 140 is positioned so as to overlap the edge of back panel 120 and adhesive is applied to the overlapping areas so as to affix the overlapping areas to one another.

A display cut-out 145 may be provided in front panel 120 of the primary blank 101. Accordingly, although not shown, cut-out 145 may be formed when a perforation is used to remove material (not shown) from the container 100 so as to provide an access opening for product displayed in the container 100. Opening 145 may be in communication with an open top end of the container 100, which, during use as a display, may be free of any top wall or panel following modification of the container 100 for the display function of the dual-use container. It is within the scope of the present disclosure that the opening 145 may be omitted, for example, if the container 100 is to be used only as a shipping container. Additionally, it is within the scope of the present disclosure that container 100 may include a top (not shown).

Figure 5:
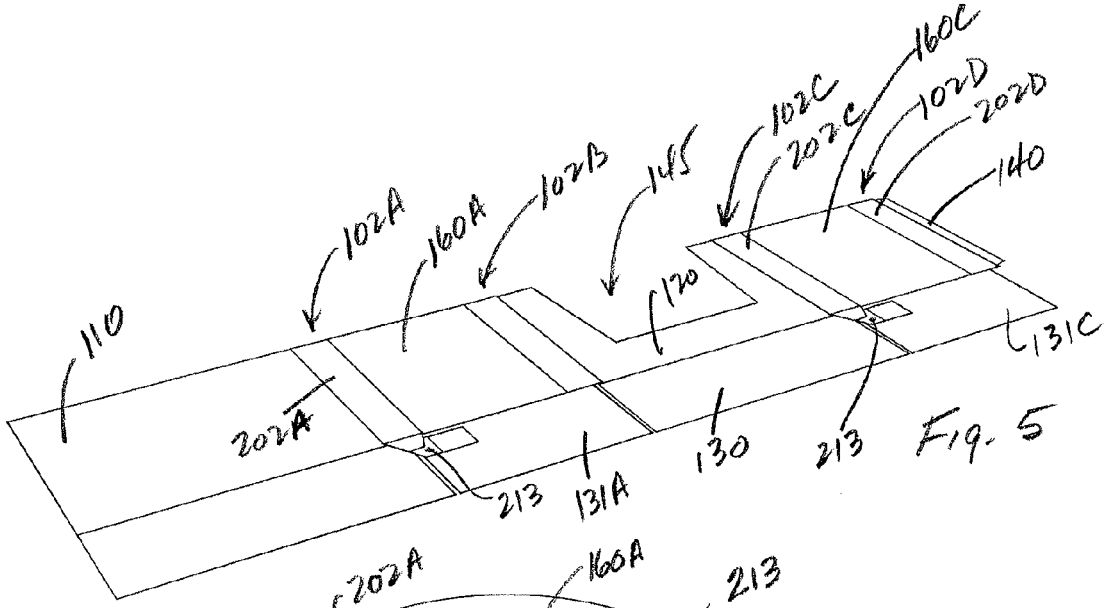
FIG. 5 is a perspective view of the supplementary blanks and primary blank of FIG. 4 attached together and lying in a substantially flat, unfolded condition in a first stage of assembly of a pre-assembly of the container of FIG. 1.

FIG. 4 also illustrates an example of supplementary blanks 103 configured to include support sections 102, as previously illustrated in FIGS. 1 and 2. Support sections 102A-D are each hingedly connected via a living hinges or working scores 152A, 152B, 152C and 152D to respective central sections 160A and 160C. Those working score connections for support sections 102A-D allow alteration of the angle between each support section 102A-D and respective central sections 160A and 160C. As part of the pre-assembly manufacturing, the central sections 160A and 160C may be affixed to corresponding side panels 105 and 110 of the primary blank 101, as suggested by, for example, the glue or adhesive lines or points 213 in FIG. 4 and as further shown in FIG. 5. FIG. 6 is an enlarged view of a portion of FIG. 5 showing center section 160A of supplementary blank 103 affixed to primary blank 101. Pad 402A is affixed to bottom panel 131A via adhesive area 213 (see FIG. 4). Also, for example, tab 502A is shown to be configured to fold at score 602A and separate from extension 302A at knife cut 352A, as suggested in FIG. 6, and to be affixed to pad 402A. The result is visible in FIG. 8, where the pre-assembly 300 of FIG. 7 is not yet in the flattened, pre-assembly position. Pre-assemblies, such as pre-assembly 300 in FIG. 7, are shipped to customers in this flattened configuration and are assembled or erected by the customers, manually or by automated means. Supplementary blanks 103A and 103C are interchangeable in that either blank 103 can be affixed to either side panel 105 or 115

Figure 9:
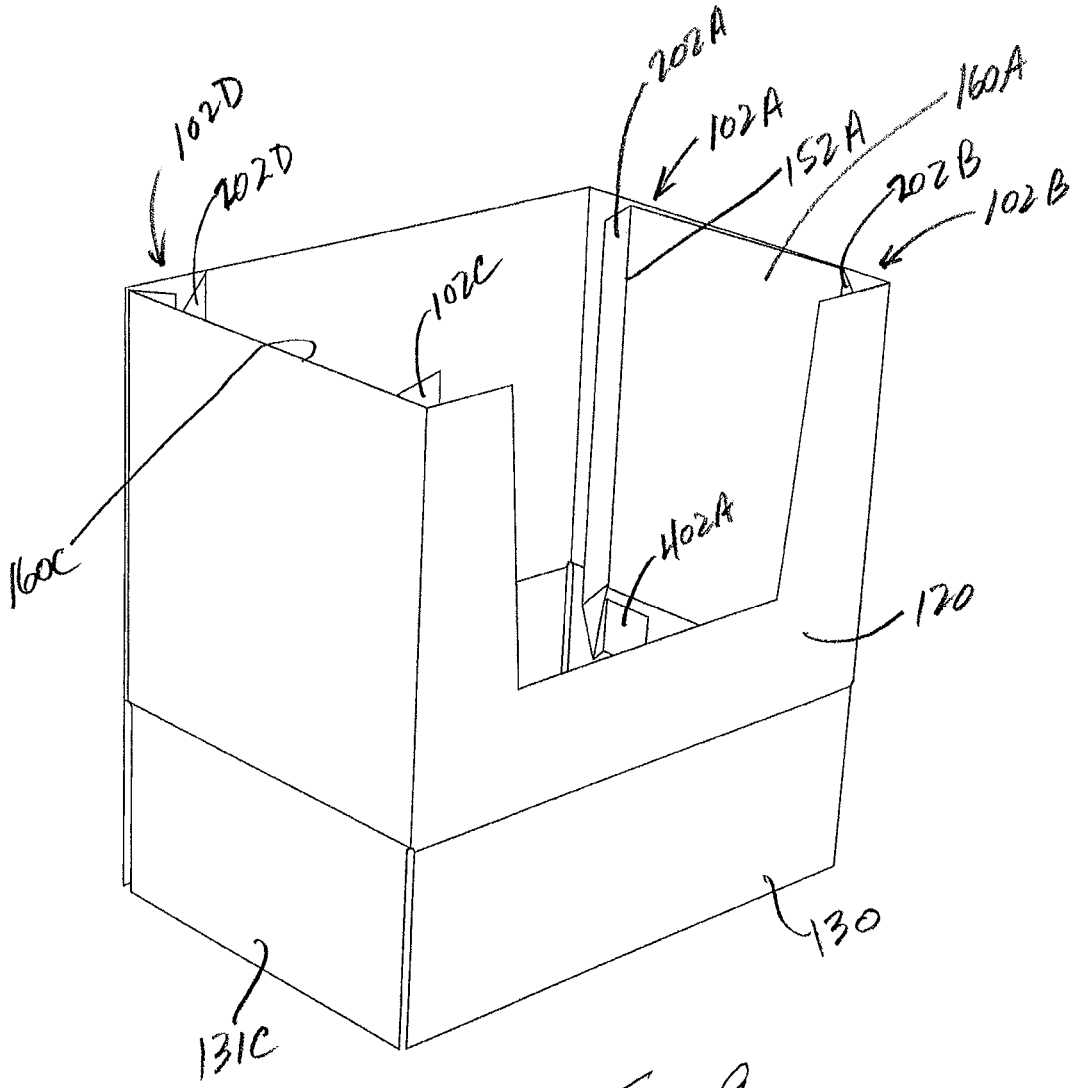
FIG. 9 is a perspective view of a partially erected container, manufactured in accordance with the present disclosure.
Figure 10:
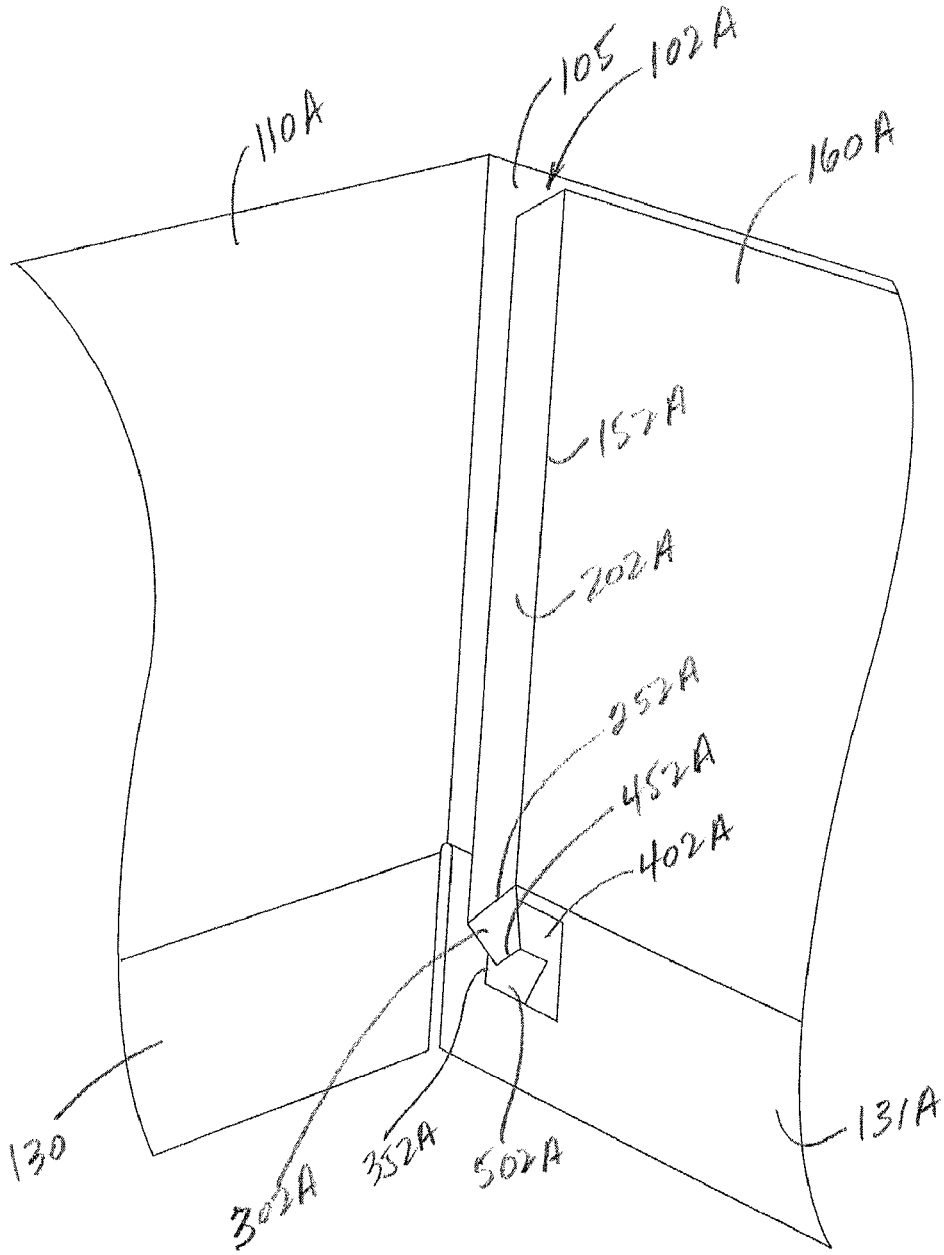
FIG. 10 is a perspective, cut-away view of a corner of the assembled and partially erected container of FIG. 9.

Regardless of which supplementary blank 103 is affixed to which side panel 105, 115, the initial opening of the pre-assembly 300 results in the support sections 102B and 102D snapping into positions extending diagonally across their respective corners of the container 100 and results in the support sections 102A and 102C extending at a predetermined angle such as, for example, substantially a 90° angle relative to their central sections 160A,C, as shown in FIGS. 9 and 10. Support sections 102A,C eventually extend diagonally across their respective corners of container 100 when panel movers 200A and 200C, including pads 402A,C affixed to minor flaps 131A, 131C, are employed during final assembly or erection of the container 100 from the pre-assembly 300.

The appropriate faces or surfaces of the primary blank 101 and supplementary the blanks 103 may be affixed to each other in one or more suitable manners including application of adhesive on one or both of the affixed faces, use of staples, tape, etc. However, of particular utility may be the use of adhesive to attach the blanks 101 and 103 together. Such an adhesive may be selected from various different types of adhesives that enable varying speeds of set times and strengths of adherence. For example, the blanks 101 and 103 may be adhered to one another using an adhesive that may be what is referred to in the packaging industry as a "cold-set" adhesive, meaning that the adhesive is not heated prior to application. Such adhesives generally take longer to set, i.e., provide adherence of the materials being joined. However, such adhesives also generally provide a relatively strong bond. Cold-set adhesives differ from what are referred to as "hot-melt" adhesives, which generally set relatively faster but provide a relatively weaker bond.

Thus, it should further be appreciated that cold-set adhesives provide for the ability to alter positioning by, for example, a lateral sliding movement, immediately following initial contact between the blanks 101 and 103. Therefore, it should be understood that the folding operations performed as part of pre-assembly manufacture, and explained further below, may result in some lateral sliding movement between the blanks 101 and 103 during the pre-assembly folding operations.

Following from what is shown or suggested in FIGS. 4, 5 and 8, primary blank 101 includes fold lines or living hinges or working scores 111A and 111C. Supplementary blanks 103A and 103C include fold lines or living hinges or working scores 602A and 602C, respectively. When pre-assembly materials, that is blanks 101 and 103, are affixed and folded, working scores 111A and 111C on primary blank 101 move working scores 602A and 602C on supplemental blanks 103A and 103C to enable the affixing, for example, using a glue adhesive, of tab 502A to pad 402A, the affixing of back panel 110 to side panel 115, and the movement of support sections 102A-D to a flattened position with: inboard support panel 102B spanning portions of side panel 105 and front panel 120 and being sandwiched between back panel 110 and side panel 105 and front panel 120; inboard support panel 102D spanning portions of side panel 115 and back panel 110 and being sandwiched between front panel 120 and side panel 115 and back panel 110; outboard support panel 102A lying between back panel 110 and center section 160A; and, outbound support panel 102C lying between front panel 120 and center section 160C.

Figure 11:
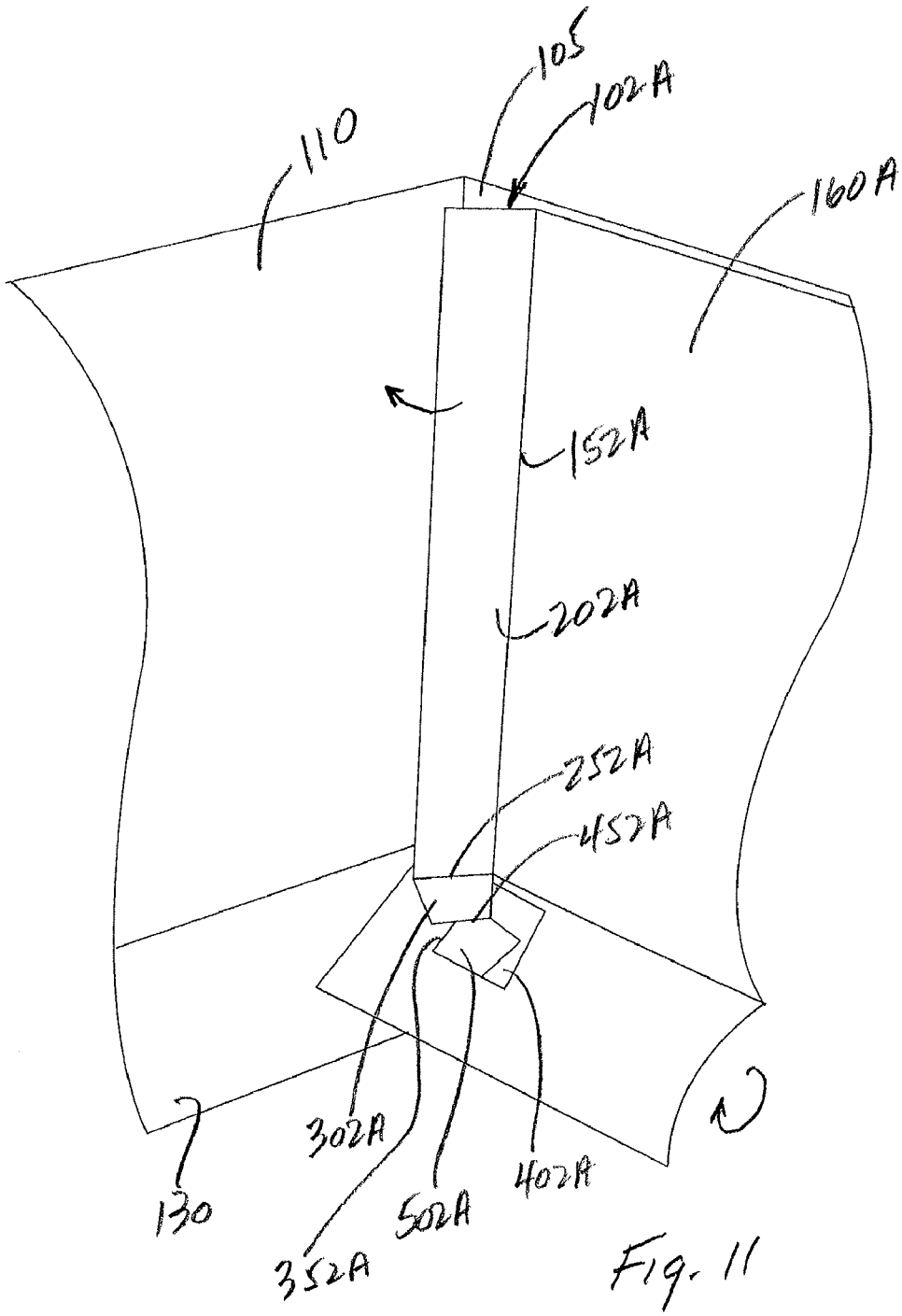
FIG. 11 is a perspective, cut-away view of a first stage of movement of the corner section of the container of FIG. 10.
Figure 12:
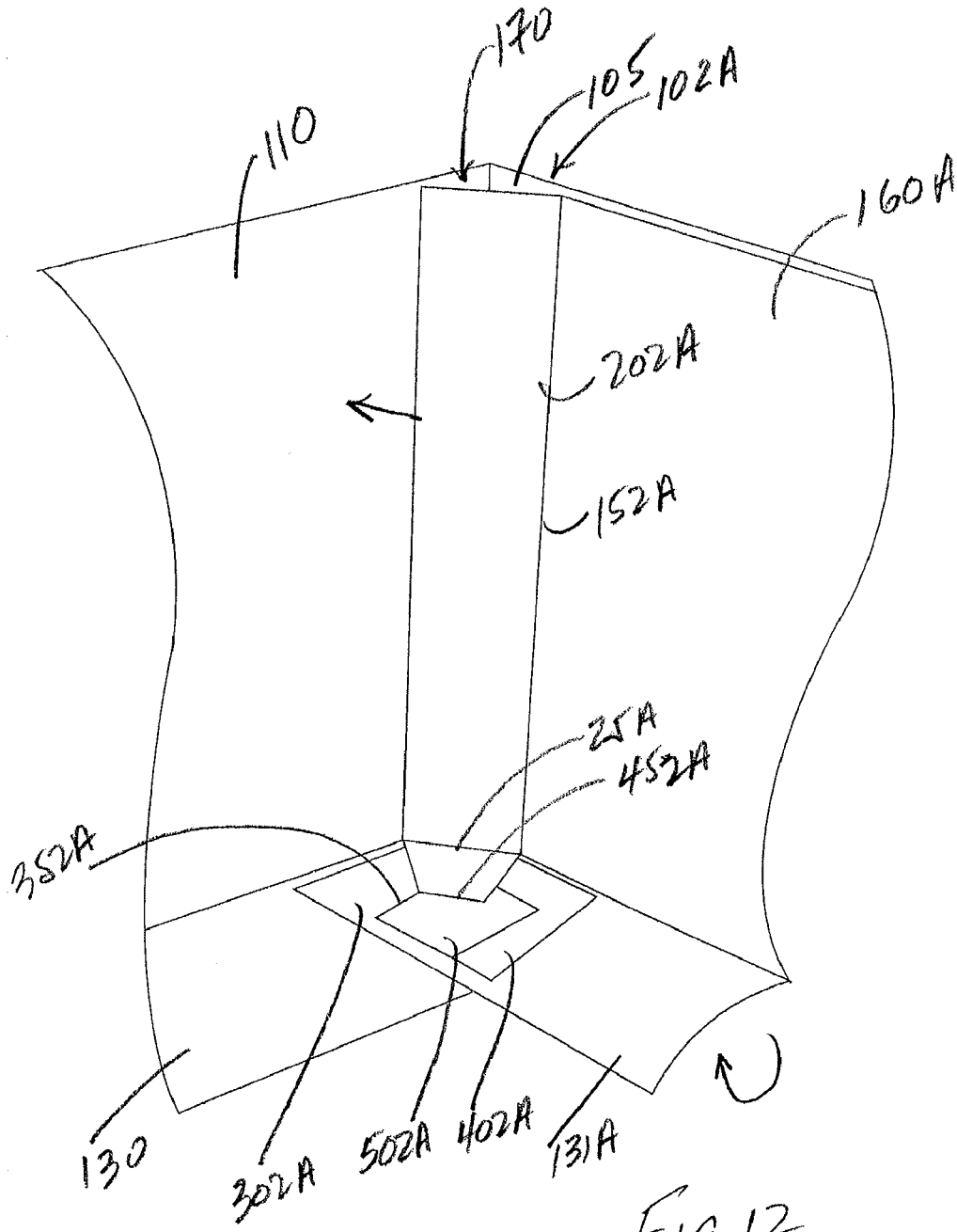
FIG. 12 is a perspective, cut-away view of the final stage of movement of the corner section of the container of FIG. 11.

Because the working scores 111A, 111C on the primary blank 101 are needed to move the working scores 602A, 602C on supplemental blanks 103A, 103C to properly move and place the support panels 202A and 202C in a flattened position yet maintaining their capacity to function properly during erection of pre-assembly 300 into container 100, the support section movers 200A and 200C need to be disposed on the support sections 102A and 102C of supplemental blanks 103A and 103C nearest the working scores 111A and 111C of primary blank 101. Thus disposed, when the pre-assembly 300 is opened to a partially erected condition (see FIGS. 9 and 10), the two inboard support sections 102B, 102D move or snap into place in their desired positions extending diagonally across their respective corners. However, support panels 102A,C are moved differently. When bottom panel or minor flap 131 is moved from its initial erected position in FIG. 10 through a partially erected position in FIG. 11 to a final erected position in FIG. 12, as suggested by the arrows, minor panel 131A has enabled panel mover 200A to move support panel 202A to its desired position extending diagonally across its respected corner between side panel 105 and back panel 110. Movement of panel mover 202A is enabled by living hinges or working scores 152A, 252A and 452A, as suggested in FIGS. 10-12. In accordance with the present disclosure, the erection of container 100 from pre-assembly 300 can be accomplished either manually or by an appropriate mechanized or automatic process or a combination thereof. Furthermore, while two panel movers 200A,B are shown herein, it within the scope of the present disclosure that pre-assembly 300 and container 100 may include only one such mover or more than two such movers.

Thus, as shown in FIGS. 4-8, manufacture of pre-assembly 300 is shown in an exemplary manner wherein the blanks 103 are affixed to the side panels 105, 115 of blank 101. It is within the scope of the present disclosure wherein blanks 103 may be affixed to other panels of primary blank 101.

As a result of cooperation of the components of blanks 101 and 103 when container 100 is erected, one or more optional air cells 170 may be created in the container 100, as shown, for example, in FIGS. 1 and 2.

A finally assembled container 100 is formed, for example, in a rectangular configuration, with side panels 105, 110 and front and rear panels 120, 110 forming a respective pair of opposing walls. Further, container 100 includes increased strength by not only the support sections 102A-D at the corners of the container 100 where the various panels intersect, but also by the optional air cell 170 provided at those same corners. However, it should be appreciated that a majority of the increased strength and anti-nesting characteristics is due to the plurality of support sections 102A-D of the supplementary blanks 103 extending diagonally across respective corners of the container 100.

Although FIGS. 1-12 illustrate one example of a container that may be manufactured in accordance with present disclosure, various different types of blanks and pre-assemblies may be used to produce various different types of containers. Thus, although one or more of the panels may be configured in a rectangular shape, various other shapes are also suitable. Further, although not illustrated in FIGS. 1-12, one of the disclosed blanks 101, 103 or a different blank may be used to construct the exterior of the container 100 and may also include a top panel of various suitable shapes and sizes.

Figure 13:
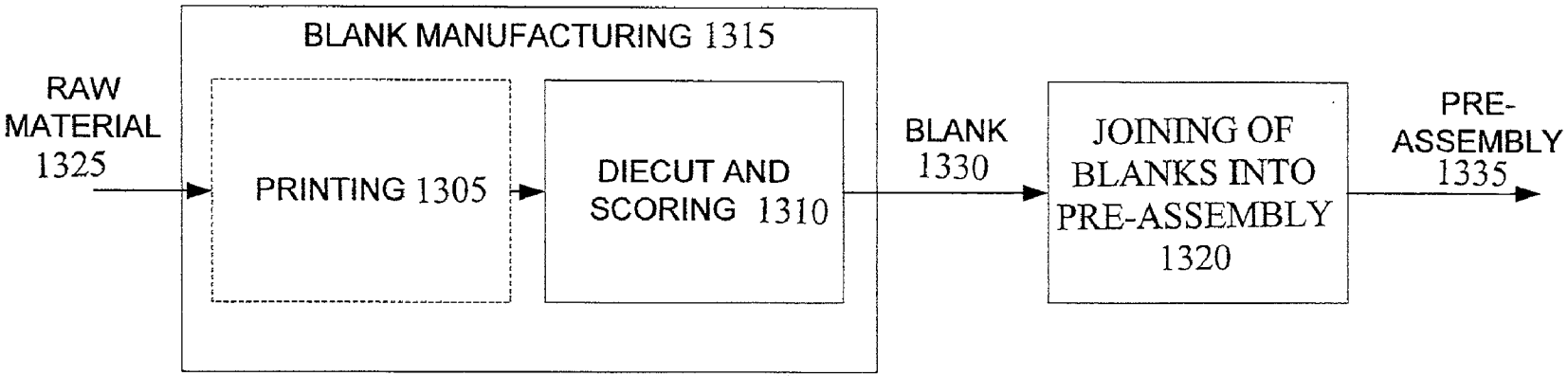
FIG. 13 illustrates a functional block diagram used to describe the manufacturing method of a container pre-assembly, in accordance with the present disclosure.

FIG. 13 illustrates a functional block diagram showing the operation of various method functions performed in accordance with a method of producing pre-assemblies in conjunction with present disclosure. With regard to the manufacturing of containers such as the container 100 shown in FIGS. 1-12, the manner of manufacturing such a container may be conveniently described in two phases: pre-assembly and final assembly/erection.

Pre-assembly is normally performed at a container manufacturing facility to produce a pre-assembly, which may also be thought of and referred to as a knock-down of the container. These pre-assemblies may be shipped to a customer location such as a product manufacturing facility. At the product manufacturing facility, the customer may perform final assembly/erection of the containers by, for example, folding and assembling various panels of the container to provide a container that is configured to hold manufacture product, e.g., for shipping and/or display.

In such operations, the labelling of the resulting containers may be performed by the customer of the pre-assemblies and/or as part of manufacture of the pre-assemblies as illustrated in FIG. 13.

FIG. 13 illustrates various functional operations performed as part of the manufacture of a pre-assembly by, for example, a container manufacturer. The operations may begin, for example, with printing 1305 of container material prior to the container material being die cut and/or scored 1310 as part of an overall blank manufacturing operation 1315. The manufactured blanks 1330 may or may not be printed on one or both sides of the blanks 1330 depending on customer requirements. Accordingly, the printing operation 1305 may be omitted.

Subsequent to blank manufacturing 1315, multi-blank pre-assembly operations may be performed, such as suggested in step 1320 in FIG. 13, in various suitable manners by hand or using various commercially available machines (for example, those produced by Bahmueller Technologies, Inc. of Charlotte, N.C., USA or Bobst Group North America of Roseland, N.J., USA), to produce pre-assemblies for a reinforced container such as that illustrated in FIGS. 1-12, for example.

Thus, at the beginning of such operations, raw material 1325 is used to produce blanks 1330. Such raw materials 1325 may include but are not limited to various grades, types, configurations and combinations of corrugated fiberboard and/or solid paperboard, liner board, board of various fluting types and combinations as well as various types of sealants, non-organic materials and inks and dies of various suitable types.

It should be understood that implementation of the method of manufacturing and the pre-assembles and blanks according to the present disclosure involves performing or completing certain selected tasks or steps manually, automatically, or a combination thereof.

While the present disclosure has been described in conjunction with an illustrated embodiment described above, it should be evident that many alternatives, modifications and variations will be apparent to those skilled in the art. Accordingly, the embodiment of the present disclosure, as set forth above, is intended to be illustrative, not limiting. Various changes may be made without departing from the spirit and scope of the present disclosure. Thus, it should be understood that containers come in many different varieties but most packaging containers can be folded and then assembled from a flat form, known as a blank or pre-assembly. Accordingly, it should be understood that the pattern for any blank, pre-assembly or container may be different than that described herein.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A method of manufacturing a container, the method comprising:

cutting a primary blank including a front panel, back panel, two side panels and at least one bottom panel;

cutting at least one supplementary blank including at least one central section and at least one support section having at least one support panel extending via a first working score from the central section and a support panel mover extending from the at least one support panel;

affixing the at least one central section of the at least one supplementary blank to one of the panels of the primary blank to form a pre-assembly for the container, the at least one support panel extending past an edge of the panel of the primary blank to which the central section is affixed;

affixing the support panel mover of the at least one support panel to the at least one bottom panel; and assembling the container from the pre-assembly such that movement of the at least one bottom panel to its final assembled position automatically moves the at least one support panel to a position extending diagonally across a corner of the container formed by the one panel of the primary blank and an adjacent panel to the one panel of the primary blank.

2. The method according to claim 1, wherein the support panel mover of the at least one support panel includes an extension extending from and coupled to the at least one support panel via a second working score, a tab coupled to the extension via a third working score, and a pad coupled to the tab via a fourth working score and affixed to the at least one bottom panel.

3. The method according to claim 2, wherein movement of the at least one bottom panel to its final assembled position results in rotation of the extension about the third working score, and rotation of the at least one support panel about the first and second working scores to a position extending across the corner of the container formed by the one panel of the primary blank and the adjacent panel of the primary blank.

4. The method according to claim 2, wherein the primary blank further includes a working score connecting the one panel of the primary blank and the adjacent panel to the one panel, and during the forming of the pre-assembly into a flattened position, movement about the working score of the primary blank moves the first and fourth working scores of the supplemental blank to enable the affixing of the tab to the pad and a flattening of the at least one support panel such that it lies between the two adjacent panels of the primary blank.

5. The method of claim 1, wherein the supplementary blank is cut to include two support panels extending via working scores from opposite sides of the central section and each one of the support panels is configured to extend past an opposed lateral edge of the one panel to which the central section is affixed, and when the container is fully assembled, one of the support panels snaps into place and extends diagonally across a corner of the container formed by the one panel and an adjacent panel and the other one of the support panels includes the support panel mover and is automatically moved into position extending diagonally across a corner of the container formed by the one panel of the primary blank and adjacent panel of the one panel by movement of the at least one bottom panel.

6. The method of claim 1, wherein cutting the at least one supplementary blank further comprises cutting two supplementary blanks, each supplementary blank including at least one central section and at least one support section having at least one support panel extending from the central section, via first working scores, and the support panel mover extending from each of the at least one support panels, and the affixing of the at least one central section of the at least one supplementary blank to one of the panels of the primary blank further comprises affixing the central section of each supplementary blank to a different one of the panels of the primary blank and affixing the support panel mover of each supplementary blank to a respective at least one bottom panel, and when the container is fully assembled, at least one of the support panels for each supplementary blank is automatically moved to extend diagonally across a corner of the container formed by the panel to which the central section is affixed and an adjacent panel when the respective at least one bottom panel is moved to its fully assembled position.

7. The method of claim 1, wherein the at least one central section and the panel to which it is affixed are cut to have the same height.

8. The method of claim 1, wherein the primary blank and the at least one supplementary blank are affixed to one another via application of an adhesive.

9. The method of claim 1, wherein, when the container is fully assembled, at least one air cell is provided between the at least one corner panel of the supplementary blank and an intersection of the one panel and the adjacent panel the primary blank.

10. The method according to claim 1, wherein the support panel mover is cut to be generally L-shaped.

11. The method according to claim 10, wherein a top portion of a first leg of the L-shape is connected to the at least one support panel by a second score, a bottom portion of the first leg is connected to the top portion by a third score, and a second leg of the L-shape is connected to the bottom portion of the front leg by a fourth score.

12. The method according to claim 11, wherein the first and fourth scores are parallel to each other and the second and third scores are transverse to the first and second scores.

13. The method according to claim 11, wherein the first and fourth scores are parallel to each other and substantially coaxial.

14. The method according to claim 11, wherein the top portion is trapezoidal shaped with first and second parallel sides and third and fourth non-parallel sides, the first parallel side being the second score and the third non-parallel side being the third score.

15. The method according to claim 14, wherein the second parallel side is separated from the at least one bottom portion.

16. The method according to claim 12, wherein the second and third scores are transverse to each other.

17. The method according to claim 4, wherein the first and fourth scores are parallel to each other and the second and third scores are transverse to the first and second scores.

18. The method according to claim 4, wherein the first and fourth scores are parallel to each other and substantially coaxial.

19. The method according to claim 4, wherein the support panel mover is cut to be L-shaped.

20. The method according to claim 19, wherein the extension is a part of a first leg of the L-shape and is connected to the at least one support panel by the second working score, the tab is part of the first leg and is connected to the extension by the third working score, and a second leg of the L-shape includes the pad which is connected to the tab by the fourth working score.

21. The method according to claim 20, wherein the extension is trapezoidal shaped with first and second parallel sides and third and fourth non-parallel sides, the first side being the second working score and the third non-parallel side being the third working score.

22. A container pre-assembly comprising:

a primary blank including a front panel, back panel, two side panels and at least one bottom panel, wherein at least two of the panels are connected by a first working score enabling the connected panels to rotate relative to one another, at least one supplementary blank including at least one central section and at least one support section having at least one support panel extending from the central section via a second working score enabling the at least one support panel to rotate relative to the at least one central section, the at least one central section of the at least one supplementary blank and one of the panels of the primary blank being affixed together, and a support panel mover coupled at one end to the at least one support section and at another end to the at least one bottom panel.

23. The pre-assembly according to claim 22, wherein the support panel mover is cut to be generally L-shaped.

24. The pre-assembly according to claim 23, wherein a top portion of a first leg of the L-shape is connected to the at least one support panel by a second score, a bottom portion of the first leg is connected to the top portion by a third score, and a second leg of the L-shape is connected to the bottom portion of the front leg by a fourth score.

25. The pre-assembly according to claim 24, wherein the first and fourth scores are parallel to each other and the second and third scores are transverse to the first and second scores.

26. The pre-assembly according to claim 24, wherein the first and fourth scores are parallel to each other and substantially coaxial.

27. The pre-assembly according to claim 24, wherein the top portion is trapezoidal shaped with first and second parallel sides and third and fourth non-parallel sides, the first parallel side being the second score and the third non-parallel side being the third score.

28. The pre-assembly according to claim 27, wherein the second parallel side is separated from the bottom portion.

29. The pre-assembly according to claim 25, wherein the second and third scores are transverse to each other.

30. The pre-assembly according to claim 22, wherein the support panel mover of the at least one support panel includes an extension extending from and coupled to the at least one support panel via a second working score, a tab coupled to the extension via a third working score, and a pad coupled to the tab via a fourth working score and affixed to the at least one bottom panel.

31. The pre-assembly according to claim 30, wherein the primary blank further includes a working score connecting the one panel of the primary blank and the adjacent panel to the one panel, and during the forming of the pre-assembly into a flattened position, movement about the working score of the primary blank moves the first and fourth working scores of the supplemental blank to enable the affixing of the tab to the pad and a flattening of the at least one support panel such that it lies between the two adjacent panels of the primary blank.

32. The pre-assembly according to claim 31, wherein the extension is a part of a first leg of the L-shape and is connected to the at least one support panel by the second working score, the tab is part of the first leg and is connected to the extension by the third working score, and a second leg of the L-shape includes a pad which is connected to the tab by the fourth working score.

33. The pre-assembly according to claim 32, wherein the extension is trapezoidal shaped with first and second parallel sides and third and fourth non-parallel sides, the first side being the second working score and the third non-parallel side being the third working score.

34. The pre-assembly according to claim 22, wherein the at least one supplementary blank includes two support panels extending via working scores from opposite sides of the central section and each one of the support panels is configured to extend past an opposed lateral edge of the one panel to which the at least one central section is affixed, and when the container is fully assembled, one of the support panels snaps into place and extends diagonally across a corner of the container formed by the one panel and an adjacent panel and the other one of the support panels includes the support panel mover and is automatically moved into position extending diagonally across a corner of the container formed by the one panel of the primary blank and adjacent panel of the one panel by movement of the at least one bottom panel.

35. The pre-assembly according to claim 22, wherein the at least one supplementary blank further comprises two supplementary blanks, each supplementary blank including at least one central section and at least one support section having at least one support panel extending from the at least one central section, via first working scores, and the support panel mover extending from each of the at least one support panels, and the at least one central section of the at least one supplementary blank is affixed to one of the panels of the primary blank and the central section of each supplementary blank is affixed to a different one of the panels of the primary blank and the support panel mover of each supplementary blank is affixed to a respective at least one bottom panel, and when the container is fully assembled, at least one of the support panels for each supplementary blank is automatically moved to extend diagonally across a corner of the container formed by the panel to which the central section is affixed and an adjacent panel when the respective at least one bottom panel is moved to its fully assembled position.

36. A plurality of blanks for a container, the plurality of blanks comprising:

a primary blank including a front panel, back panel, two side panels and at least one bottom panel;

at least one supplementary blank including at least one central section and at least one support section having at least one support panel extending from the at least one central section via a first working score, the at least one supplementary blank being configured to mate with and be affixed to one of the panels of the primary blank;

the at least one support section including a support panel mover coupled thereto via a second working score and configured to be affixed to the at least one bottom panel; and wherein after the blanks are affixed to one another and when the container is fully assembled from a movement of the blanks, the at least one support panel is automatically moved by the support panel mover via the first and second working scores such that the at least one support panel extends diagonally across a corner of the fully assembled container formed by the one panel of the primary blank and an adjacent panel of the primary blank connected by a third working score.

37. The plurality of blanks according to claim 36, wherein the support panel mover is cut to be generally L-shaped.

38. The plurality of blanks according to claim 37, wherein a top portion of a first leg of the L-shape is connected to the at least one support panel by a second score, a bottom portion of the first leg is connected to the top portion by a third score, and a second leg of the L-shape is connected to the bottom portion of the front leg by a fourth score.

39. The plurality of blanks according to claim 38, wherein the first and fourth scores are parallel to each other and the second and third scores are transverse to the first and second scores.

40. The plurality of blanks according to claim 38, wherein the first and fourth scores are parallel to each other and substantially coaxial.

41. The plurality of blanks according to claim 38, wherein the top portion is trapezoidal shaped with first and second parallel sides and third and fourth non-parallel sides, the first parallel side being the second score and the third non-parallel side being the third score.

42. The plurality of blanks according to claim 41, wherein the second parallel side is separated from the bottom portion.

43. The plurality of blanks according to claim 39, wherein the second and third scores are transverse to each other.

44. The plurality of blanks according to claim 36, wherein the support panel mover of the at least one support panel includes an extension extending from and coupled to the at least one support panel via a second working score, a tab coupled to the extension via a third working score, and a pad coupled to the tab via a fourth working score and affixed to the at least one bottom panel.

45. The plurality of blanks according to claim 44, wherein the primary blank further includes a working score connecting the one panel of the primary blank and the adjacent panel to the one panel, and during the forming of the pre-assembly into a flattened position, movement about the working score of the primary blank moves the first and fourth working scores of the supplemental blank to enable the affixing of the tab to the pad and a flattening of the at least one support panel such that it lies between the two adjacent panels of the primary blank.

46. The plurality of blanks according to claim 45, wherein the extension is a part of a first leg of the L-shape and is connected to the at least one support panel by the second working score, the tab is part of the first leg and is connected to the extension by the third working score, and a second leg of the L-shape includes a pad which is connected to the tab by the fourth working score.

47. The plurality of blanks according to claim 46, wherein the extension is trapezoidal shaped with first and second parallel sides and third and fourth non-parallel sides, the first side being the second working score and the third non-parallel side being the third working score.

48. The plurality of blanks according to claim 36, wherein the at least one supplementary blank includes two support panels extending via working scores from opposite sides of the central section and each one of the support panels is configured to extend past an opposed lateral edge of the one panel to which the at least one central section is affixed, and when the container is fully assembled, one of the support panels snaps into place and extends diagonally across a corner of the container formed by the one panel and an adjacent panel and the other one of the support panels includes the support panel mover and is automatically moved into position extending diagonally across a corner of the container formed by the one panel of the primary blank and adjacent panel of the one panel by movement of the at least one bottom panel.

49. The plurality of blanks according to claim 36, wherein the at least one supplementary blank further comprises two supplementary blanks, each supplementary blank including at least one central section and at least one support section having at least one support panel extending from the at least one central section, via first working scores, and the support panel mover extending from each of the at least one support panels, and the at least one central section of the at least one supplementary blank is affixed to one of the panels of the primary blank and the at least one central section of each supplementary blank is affixed to a different one of the panels of the primary blank and the support panel mover of each supplementary blank is affixed to a respective at least one bottom panel, and when the container is fully assembled, at least one of the support panels for each supplementary blank is automatically moved to extend diagonally across a corner of the container formed by the panel to which the central section is affixed and an adjacent panel when the respective at least one bottom panel is moved to its fully assembled position.

* * * * *